US009499990B1

(12) United States Patent
Rodriguez

(10) Patent No.: US 9,499,990 B1
(45) Date of Patent: Nov. 22, 2016

(54) SUNSHADE APPARATUS

(71) Applicant: Rafael Rodriguez, Carolina, PR (US)

(72) Inventor: Rafael Rodriguez, Carolina, PR (US)

( * ) Notice: Subject to any disclaimer, the term of this patent is extended or adjusted under 35 U.S.C. 154(b) by 0 days.

(21) Appl. No.: 14/989,913

(22) Filed: Jan. 7, 2016

(51) Int. Cl.
*E04B 1/34* (2006.01)
*E04F 10/08* (2006.01)

(52) U.S. Cl.
CPC ..... *E04F 10/08* (2013.01)

(58) Field of Classification Search
CPC ..... E04F 10/08
USPC ..... 52/74, 76, 77
See application file for complete search history.

(56) References Cited

U.S. PATENT DOCUMENTS 793,673 A * 7/1905 Mann ..... A47C 7/66 297/184.15
2,588,011 A * 3/1952 Kersey ..... E04F 10/08 52/530
2,602,971 A * 7/1952 Shaw ..... E04F 10/08 52/473
2,805,711 A 9/1957 Mehl
2,806,260 A * 9/1957 Hutchison ..... E04F 10/08 52/78
2,865,589 A * 12/1958 D Azzo ..... E04F 10/0662 160/77
2,893,073 A * 7/1959 Humphrey ..... E04F 10/08 52/542
2,894,572 A * 7/1959 Nelson ..... E04F 10/0625 160/133
2,949,649 A * 8/1960 Macy ..... E04F 10/08 52/473
3,028,706 A 4/1962 Falconer
5,135,281 A 8/1992 Pappalardo
2013/0272777 A1* 10/2013 Hayter ..... E06B 3/9645 403/205

* cited by examiner

*Primary Examiner* — Basil Katcheves
(74) *Attorney, Agent, or Firm* — Crossley & Stevenson Intellectual Property Law

(57) ABSTRACT

A sunshade apparatus including a mounting plate and a plurality of cylindrical mounting poles attached to the mounting plate. Each of a plurality of tubular support poles has a front portion, a back portion, and a pair of extensions disposed on the back portion. One of the pair of extensions is removably engageable within one of the pair of slots. A flexible covering is removably weaved through the plurality of support poles, and a securing mechanism is disposed on each of a right end and left end of a pair of ends of the covering. The securing mechanism is configured to secure each of the right end and the left end to each of a right outer support pole and a left outer support pole of the plurality of support poles. The mounting plate is attachable to one of a deck, a roof and, alternately, a side of a building.

4 Claims, 5 Drawing Sheets

SUNSHADE APPARATUS

BACKGROUND OF THE INVENTION

Various types of sunshades are known in the prior art. However, what has been needed is a sunshade apparatus including a mounting plate and a plurality of cylindrical mounting poles attached to the mounting plate. Each of a plurality of tubular support poles has a front portion, a back portion, and a pair of extensions disposed on the back portion. One of the pair of extensions is removably engageable within one of the pair of slots. A flexible covering is removably weaved through the plurality of support poles, and a securing mechanism is disposed on each of a right end and left end of a pair of ends of the covering. The securing mechanism is configured to secure each of the right end and the left end to each of a right outer support pole and a left outer support pole of the plurality of support poles. The mounting plate is attachable to one of a deck, a roof and, alternately, a side of a building. The sunshade apparatus thus provides a temporary or permanent shelter from the outside elements, depending on the preference of a user. The sunshade apparatus is easily installable on any deck, roof, and building, and the covering can also be decorated according to the preferences of the user as well.

FIELD OF THE INVENTION

The present invention relates to sunshades, and more particularly, to a sunshade apparatus.

SUMMARY OF THE INVENTION

The general purpose of the present sunshade apparatus, described subsequently in greater detail, is to provide a sunshade apparatus which has many novel features that result in a sunshade apparatus which is not anticipated, rendered obvious, suggested, or even implied by prior art, either alone or in combination thereof.

To accomplish this, the present sunshade apparatus includes a mounting plate having a front surface and a rear surface. Each of a plurality of horizontally disposed cylindrical mounting poles has a rear side attached to the front surface of the mounting plate, an open front side, and a pair of diametrically opposed slots disposed within an interior surface of the mounting pole from the front side to approximately medially between the front side and the rear side. Each of the mounting poles is perpendicularly disposed to the mounting plate, and the plurality of mounting poles is continuously disposed in a zigzag pattern on a length of the mounting plate. Each of a plurality of tubular support poles has a front portion, a back portion attached to the front portion, and a pair of diametrically opposed extensions disposed on the back portion proximal a back end of the back portion. Each of the pair of extensions is perpendicularly disposed to the back portion, and one of the pair of extensions is removably engageable within one of the pair of slots. A circumference of the back portion of each of the plurality of support poles substantially conforms to a circumference of the interior surface of each of the plurality of mounting poles, and a circumference of the front portion of each of the support poles substantially conforms to a circumference of an exterior surface of each of the plurality of mounting poles.

The sunshade apparatus further includes a flexible rectangular covering removably weaved through the plurality of support poles. A securing mechanism is disposed on each of a right end and a left end of a pair of ends of the covering. The securing mechanism is configured to selectively secure each of the right end and the left end to each of a right outer support pole and a left outer support pole of the plurality of support poles. Each of the right end and the left end of the pair of ends is hook-shaped and thereby removably securable around each of the right outer support pole and the left outer support pole, respectively, of the plurality of support poles. A width of the covering substantially conforms to a combined length of one of the plurality of mounting poles and one of the plurality of support poles. The mounting plate is attachable to one of an underside of a deck, an underside of a roof, and, alternately, a side of a building. The mounting plate, each of the plurality of mounting poles, and each of the plurality of support poles is optionally a polyvinyl chloride, and the covering is optionally a canvas fabric. The engageability of one of the pair of extensions within one of the pair of slots ensures a secure fit between one of the mounting poles and one of the support poles so that the sunshade apparatus can better withstand high winds and inclement weather.

Thus has been broadly outlined the more important features of the present sunshade apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
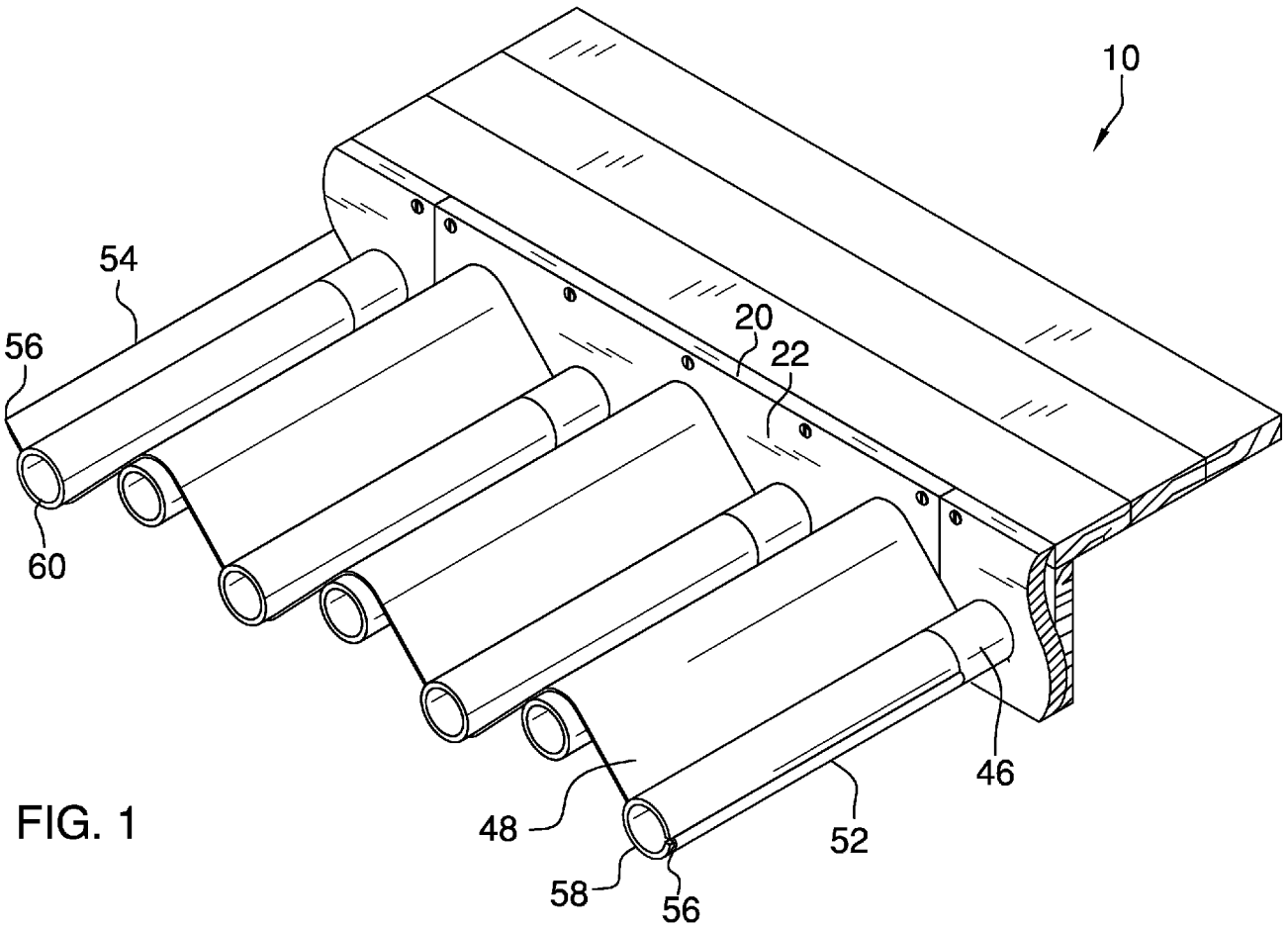
FIG. 1 is a front isometric view.
Figure 2:
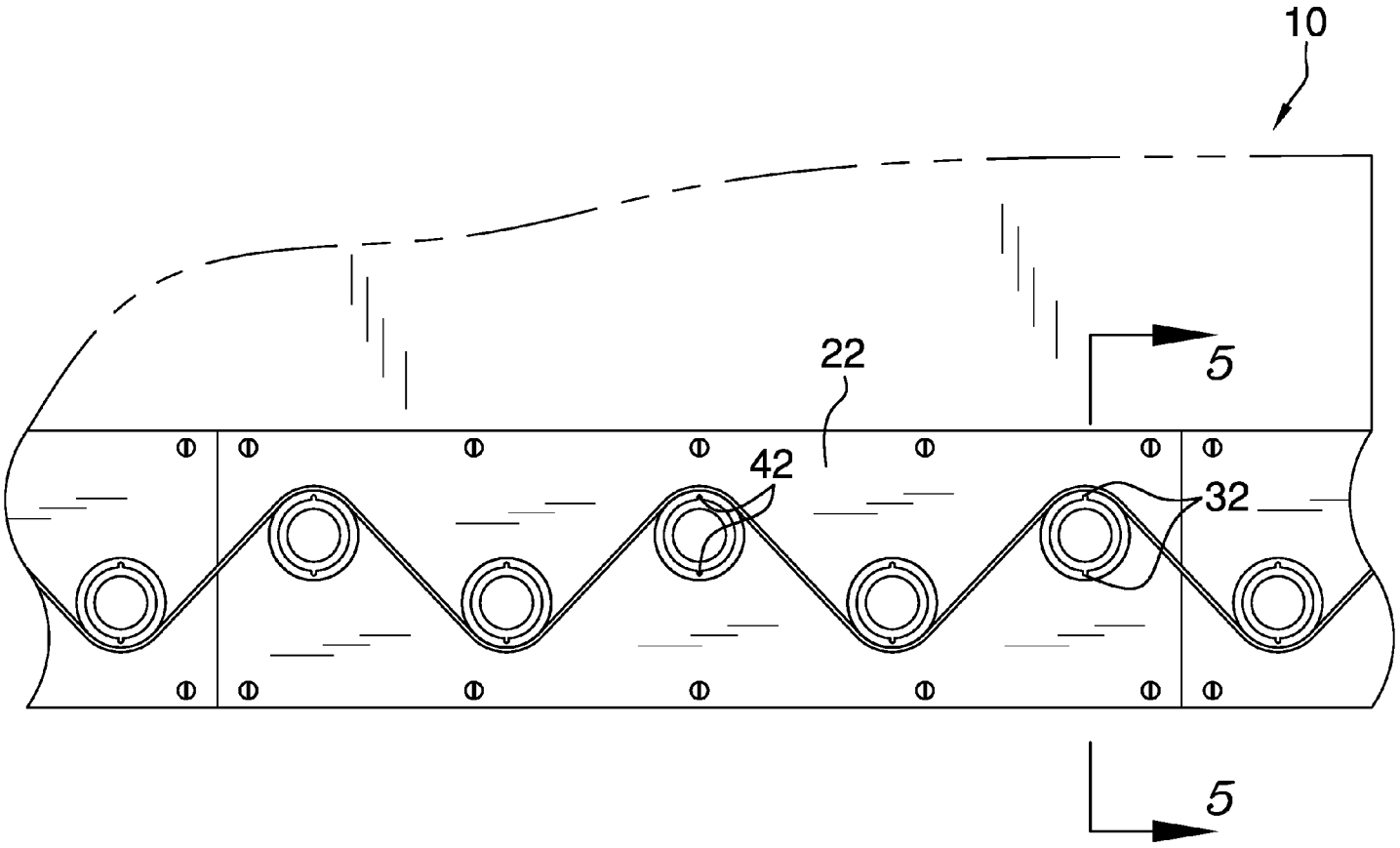
FIG. 2 is a front elevation view.
Figure 3:
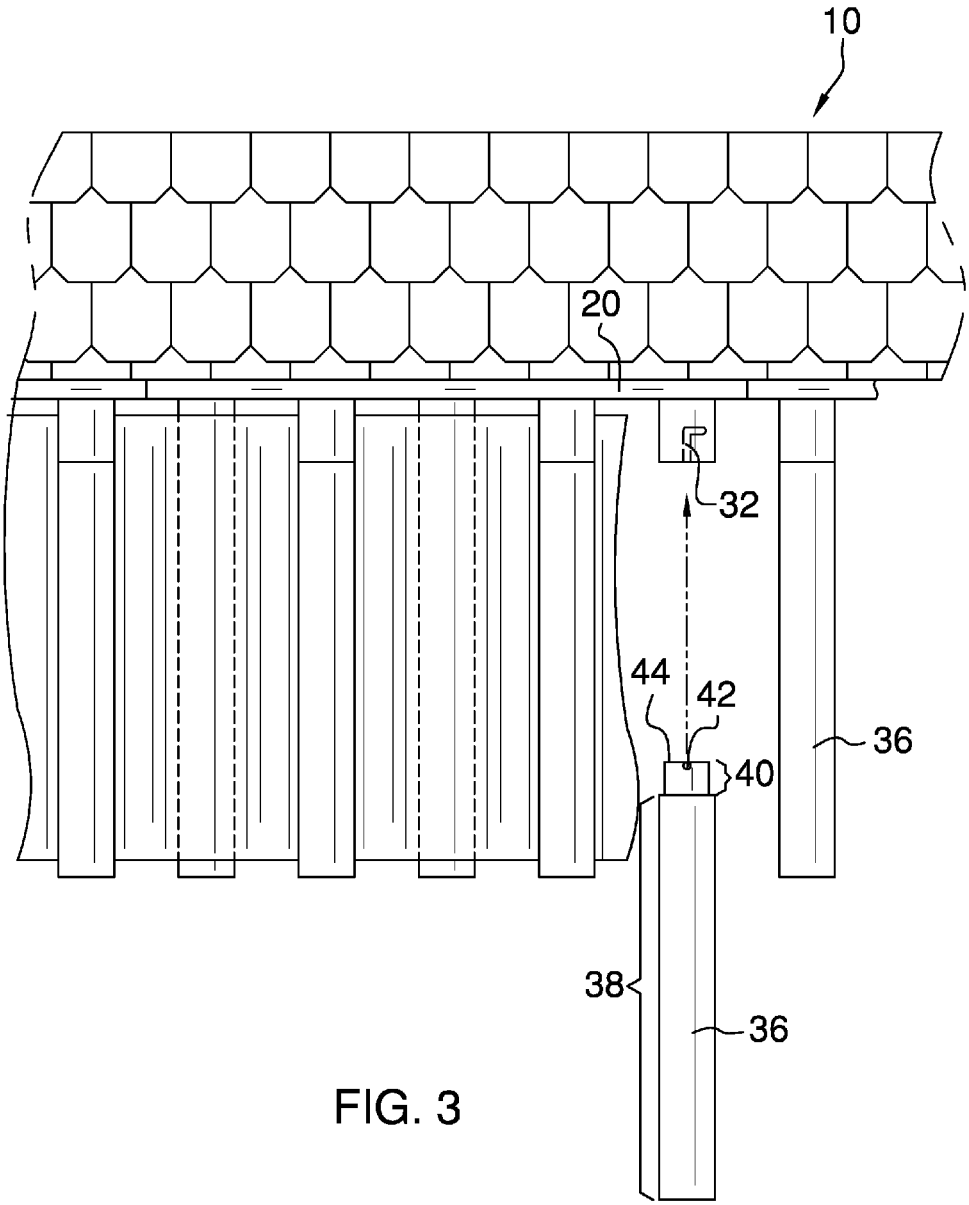
FIG. 3 is a top plan view.
Figure 4:
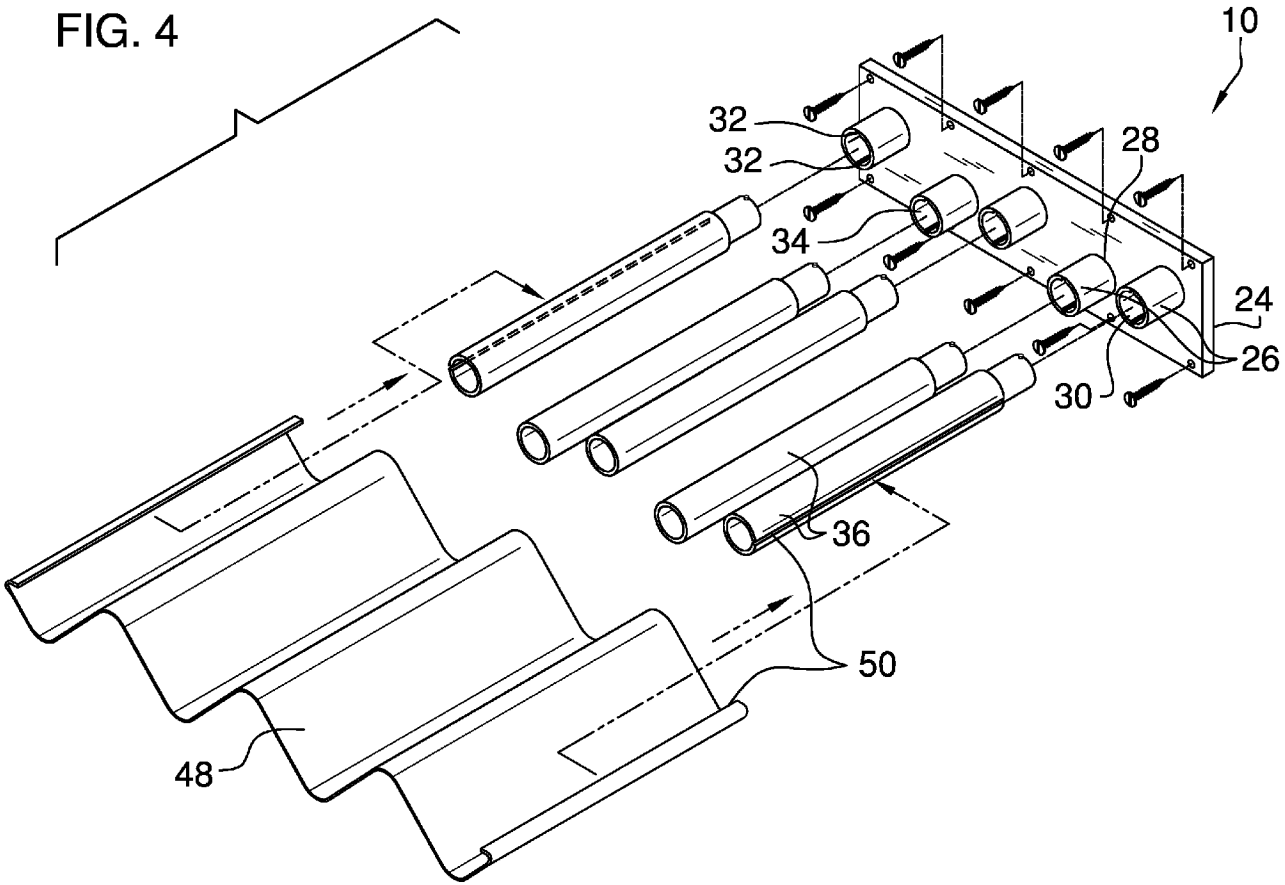
FIG. 4 is an exploded view.
Figure 5:
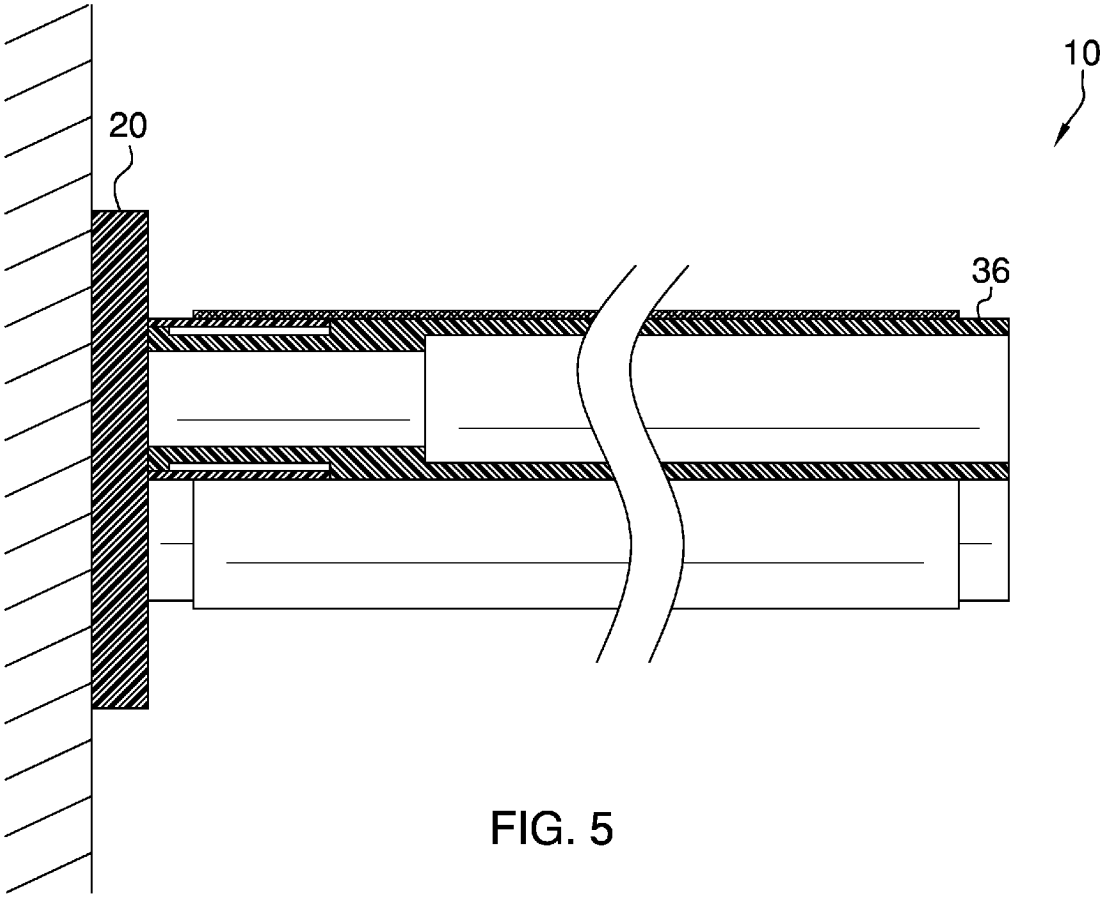
FIG. 5 is a cross-sectional view taken along line 5-5 of FIG. 2.

With reference now to the drawings, and in particular FIGS. 1 through 5 thereof, an example of the instant sunshade apparatus employing the principles and concepts of the present sunshade apparatus and generally designated by the reference number 10 will be described.

Referring to FIGS. 1 through 5 the present sunshade apparatus 10 is illustrated. The sunshade apparatus 10 includes a mounting plate 20 having a front surface 22 and a rear surface 24. Each of a plurality of horizontally disposed cylindrical mounting poles 26 has a rear side 28 attached to the front surface 22 of the mounting plate 20, an open front side 30, and a pair of diametrically opposed slots 32 disposed within an interior surface 34 of the mounting pole 26 from the front side 30 to approximately medially between the front side 30 and the rear side 28. Each of the mounting poles 26 is perpendicularly disposed to the mounting plate 20, and the plurality of mounting poles 26 is continuously disposed in a zigzag pattern on a length of the mounting plate 20. Each of a plurality of tubular support poles 36 has a front portion 38, a back portion 40 attached to the front portion 38, and a pair of diametrically opposed extensions 42 disposed on the back portion 40 proximal a back end 44 of the back portion 40. Each of the pair of extensions 42 is perpendicularly disposed to the back portion 40, and one of the pair of extensions 42 is removably engageable within one of the pair of slots 32. A circumference of the back portion 40 of each of the plurality of support poles 36 substantially conforms to a circumference of the interior surface 34 of each of the plurality of mounting poles 26, and a circumference of the front portion 38 of each of the support poles 36 substantially conforms to a circumference of an exterior surface 46 of each of the plurality of mounting poles 26.

The sunshade apparatus 10 further includes a flexible rectangular covering 48 removably weaved through the plurality of support poles 36. A securing mechanism 50 is disposed on each of a right end 52 and a left end 54 of a pair of ends 56 of the covering 48. The securing mechanism 50 is configured to selectively secure each of the right end 52 and the left end 54 to each of a right outer support pole 58 and a left outer support pole 60 of the plurality of support poles 36. A width of the covering 48 substantially conforms to a combined length of one of the plurality of mounting poles 26 and one of the plurality of support poles 36. The mounting plate 20 is attachable to one of an underside of a deck, an underside of a roof, and, alternately, a side of a building. The mounting plate 20, each of the plurality of mounting poles 26, and each of the plurality of support poles 36 is optionally a polyvinyl chloride, and the covering is optionally a canvas fabric.

What is claimed is:

1. A sunshade apparatus comprising:

a mounting plate having a front surface and a rear surface;

a plurality of horizontally disposed cylindrical mounting poles, each of the plurality of mounting poles having a rear side attached to the mounting plate front surface, an open front side, and a pair of diametrically opposed slots disposed within an interior surface of each mounting pole from the front side to medially between the front side and the rear side;

wherein each of the mounting poles is perpendicularly disposed to the mounting plate;

wherein the plurality of mounting poles is continuously disposed in a zigzag pattern on a length of the mounting plate;

a plurality of tubular support poles, each of the support poles having a front portion, a back portion attached to the front portion, and a pair of diametrically opposed extensions disposed on the back portion proximal a back end of the back portion, wherein each of the pair of extensions is perpendicularly disposed to the back portion, wherein one of the pair of extensions is removably engageable within one of the pair of slots;

wherein a circumference of the back portion of each of the plurality of support poles conforms to a circumference of the interior surface of each of the plurality of mounting poles;

wherein a circumference of the front portion of each of the support poles conforms to a circumference of an exterior surface of each of the plurality of mounting poles;

a flexible rectangular covering removably weaved through the plurality of support poles; and a securing mechanism disposed on each of a right end and a left end of a pair of ends of the covering wherein the securing mechanism is configured to selectively secure each of the right end and the left end to each of a right outer support pole and a left outer support pole of the plurality of support poles;

wherein a width of the covering substantially conforms to a combined length of one of the plurality of mounting poles and one of the plurality of support poles;

wherein the mounting plate is attachable to one of an underside of a deck, an underside of a roof, and, alternately, a side of a building.

2. The sunshade apparatus of claim 1 wherein the mounting plate is a polyvinyl chloride.

3. The sunshade apparatus of claim 2 wherein each of the plurality of mounting poles and each of the plurality of support poles is a polyvinyl chloride.

4. The sunshade apparatus of claim 3 wherein the covering is a canvas fabric.

* * * * *